United States Patent [19]

Cass et al.

[11] Patent Number: 4,471,797

[45] Date of Patent: Sep. 18, 1984

[54] HYDRAULIC CIRCUIT BREAKER RESET DEVICE

[75] Inventors: Ronald F. Cass, Yorba Linda; Shih Y. Sheng, Santa Ana, both of Calif.

[73] Assignee: Parker-Hannifin Corporation, Cleveland, Ohio

[21] Appl. No.: 359,957

[22] Filed: Mar. 19, 1982

[51] Int. Cl.[3] ..... F15B 11/08

[52] U.S. Cl. ..... 137/100; 91/446; 137/460; 137/462

[58] Field of Search ..... 137/87, 100, 459, 460, 137/462, 625.66; 91/446

[56] References Cited

U.S. PATENT DOCUMENTS

| | | | |
|---|---|---|---|
| 3,060,967 | 10/1962 | Hancock | 137/596.13 |
| 3,272,221 | 9/1966 | Flick | 137/625.66 |
| 3,685,531 | 8/1972 | Byford | 137/100 X |
| 3,971,404 | 7/1976 | Quarve | 137/462 |

*Primary Examiner*—Robert G. Nilson

*Attorney, Agent, or Firm*—James A. Baker

[57] ABSTRACT

A hydraulic system includes a pump, a reservoir, and an actuator system. A hydraulic circuit breaker is arranged to compare fluid flow to and from the actuator system and to shut off this flow in the event the flow to the actuator system is greater than the flow returning from the actuator system by more than a predetermined differential, thereby indicating a leakage condition. A hydraulic circuit breaker reset device is hydraulically connected to the actuator system and to the circuit breaker. When the circuit breaker is in a shut-off condition, the reset device continuously pressure tests the actuator system. If the pressure in the actuator system increases to indicate the absence of fluid leakage, the reset device responds to the pressure increase in the actuator system to provide a reset signal to the circuit breaker. After the circuit breaker is reset to its normal operating position, a timing piston returns the reset device to its normal operating condition.

15 Claims, 1 Drawing Figure

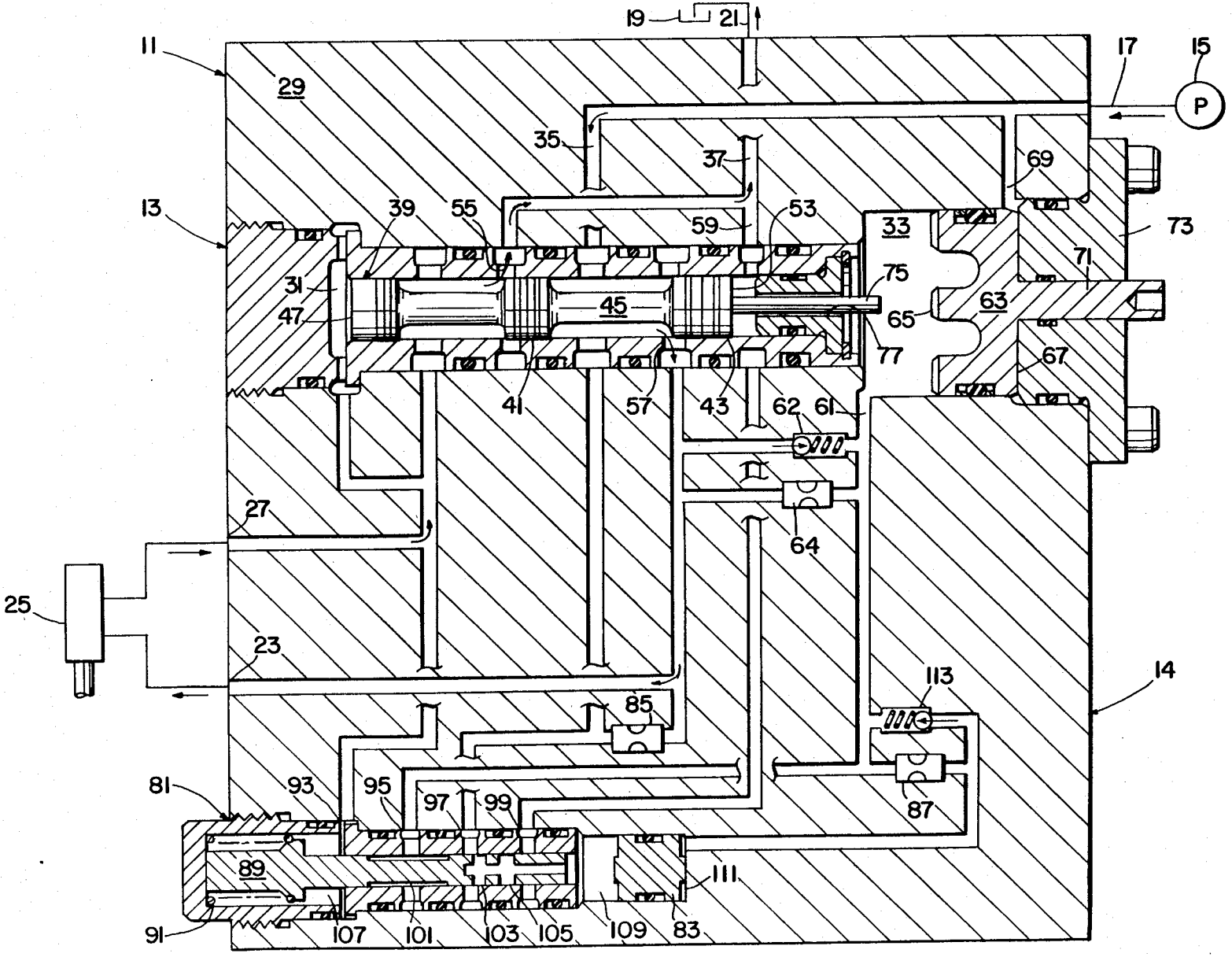
15
P
17
73
14
71
69
67
63
65
33
75
77
61
62
64
53
21
19
37
59
43
57
45
35
41
55
39
31
47
29
11
13
27
23
25
113
87
111
83
85
109
105
103
99
97
101
95
107
93
89
81
91

HYDRAULIC CIRCUIT BREAKER RESET DEVICE

BACKGROUND OF THE INVENTION

It is often desirable to provide an indication and to take remedial action when a leak of a predetermined magnitude develops in a hydraulic system. Such leak detection is particularly important in hydraulic systems used to position the control surfaces of an aircraft. In such aircraft applications, if a leak of a predetermined magnitude develops in one of the hydraulic systems of the aircraft, such systems may be shut off from the source of hydraulic fluid under pressure to prevent loss of hydraulic fluid. A hydraulic circuit breaker is utilized to accomplish this leak detection and shut off function.

In a typical aircraft hydraulic control system, hydraulic fluid is supplied to and returned from a hydraulic device. In a system of this type, the return flow is a function of the supply flow if there is no leakage in the system. Accordingly, leak detection for this type of system can be accomplished by comparing the supply and return flows.

A hydraulic circuit breaker for accomplishing this leak detection and shut off function is disclosed in Hsien Bing Wang pending U.S. patent application Ser. No. 250,398, filed Apr. 2, 1981, the entirety of which is incorporated herein by reference. As disclosed in the Wang application, a single slide valve is utilized to maintain the pressure drop across supply and return orifices substantially constant, and also to close the supply and return orifices in response to a leak of a predetermined magnitude. When it is necessary to restart the hydraulic system after the hydraulic circuit breaker shown in the Wang patent application has moved to its shut off position, it is necessary to pressurize the hydraulic circuit breaker to position the hydraulic circuit breaker in a reset mode. Devices for providing this reset pressurization may utilize an operator controlled valve for providing this reset pressure signal to the circuit breaker.

Another arrangement for resetting a hydraulic circuit breaker is shown in Frank Byford U.S. Pat. No. 3,685,531. This arrangement utilizes an accumulator piston to provide a predetermined volume of fluid under pressure to the hydraulic system. If there is no leakage in the system, this volume of fluid under pressure will pressurize the hydraulic system and reset the circuit breaker.

SUMMARY OF THE INVENTION

The present invention departs from prior art systems and provides a hydraulic system which includes a hydraulic circuit breaker and a hydraulic circuit breaker reset device.

According to the principles of the invention, the circuit breaker is arranged to detect leakage in the hydraulic system and to shut off hydraulic fluid flow to and/or from a hydraulic device. The reset device is arranged to pressure test the hydraulic system downstream of the circuit breaker after the circuit breaker has moved to its shut off position, and to detect the absence of fluid leakage which would indicate that the leak has stopped or that there was merely a "nuisance trip" of the circuit breaker. When the reset device has verified the integrity of the hydraulic system downstream of the circuit breaker, the reset device provides a reset signal to reset the hydraulic circuit breaker, and the reset device itself is thereafter reset to await the next trip of the circuit breaker.

Further according to the principles of the invention, the hydraulic system includes a supply conduit for supplying hydraulic fluid under pressure to a hydraulic device supply port, and a return conduit for returning hydraulic fluid from a hydraulic device return port. The circuit breaker includes a movable actuator which interupts the flow of fluid through the conduits in response to the fluid flow rate through the supply conduit exceeding the fluid flow rate through the return conduit by a predetermined differential.

The reset device includes a pressure test orifice which provides a metered fluid flow to the hydraulic system downstream of the circuit breaker to pressure test the hydraulic system. If there is no leakage in the hydraulic system, the pressure in the hydraulic system will increase. This increased pressure actuates a logic valve of the reset device, which then supplies a reset pressure signal to reset the circuit breaker. When the circuit breaker is reset and fluid flow resumes through the hydraulic system, a timing piston returns the logic valve to its original position to await another trip of the circuit breaker.

BRIEF DESCRIPTION OF THE DRAWING

The accompanying drawing is a schematic cross-sectional side-elevational view of a hydraulic system according to the principles of this invention, with all components of the system shown in their positions of normal operation.

DETAILED DESCRIPTION OF THE DRAWING

Referring now to the drawing in greater detail, a hydraulic system 11 includes a hydraulic circuit breaker 13 and a hydraulic circuit breaker reset device 14. The circuit breaker 13 and the reset device 14 are adapted for use with a wide variety of aircraft, industrial, and other hydraulic systems which utilize supply and return flows, and the hydraulic system 11 is but one of a wide variety of such systems.

The system 11 includes a pump 15 for providing hydraulic fluid under pressure via a supply line 17 to the circuit breaker 13 and a reservoir 19 for receiving return flow from the circuit breaker via a return line 21.

Fluid at supply pressure flows from the circuit breaker 13 through an actuator supply port 23 to a hydraulic device such as an actuator system 25 and returns from the actuator system 25 to the circuit breaker 13 through an actuator return port 27. The actuator system 25 may be conventional, and as such, it may include the usual balanced or unbalanced linear hydraulic actuator and a spool valve to control the position of the linear actuator. The spool valve may in turn be controlled, for example, by an electro-hydraulic valve. Actuator systems of this type are well known and are shown, for example, in York et al U.S. Pat. No. 3,439,707. The actuator system 25 may be used to move or position various members, such as the control surface of an aircraft.

The circuit breaker 13 is of the type that is shown and described in the above-referenced United States Patent Application Ser. No. 250,398. The circuit breaker 13 is positioned between the pump 15 and the actuator system 25 so that it can detect and respond to leakage of more than a predetermined magnitude in any part of the actuator system 25. Although the circuit breaker 13 can be of various different constructions, in the embodiment illustrated, it includes a body 29 which may be of aluminum or other suitable material having chambers 31 and 33 therein. The body 29 also has a supply conduit 35 and a return conduit 37 which provide communication between the pump 15 and the supply port 23 and between the reservoir 19 and the return port 27, respectively.

A slide valve 39 is mounted for slidable movement in the chamber 31. The slide valve 39 includes lands 41 and 43 integrally interconnected by a stem 45 of reduced diameter. The slide valve 39 also includes pressure responsive end faces 47 and 53 at its opposite ends.

The land 41 cooperates with the wall of the chamber 31 to define a variable area return orifice 55. Similarly, the land 43 cooperates with the wall of the chamber 31 to define a variable area supply orifice 57. The axial position of the slide valve 39 in the chamber 31 determines the areas of the return orifice 55 and the supply orifice 57. The areas of the orifices 55 and 57 both increase as the slide valve 39 is moved to the right as viewed in the drawing, and both of these areas decrease as the slide valve is moved to the left. The areas of the orifices 55 and 57 may be the same or different; however, preferably the orifices vary in size so that the pressure drops across the orifices during normal operation of the valve are substantially constant. The pressure drops across the supply orifice 57 during normal operation may be equal to, or different from, the pressure drop across the return orifice 55.

A passage 59 in the body 29 provides communication between the face 53 of the slide valve 39 and hydraulic fluid at return pressure downstream of the return orifice 55. A passage 61 in the body 29 provides communication between the supply fluid downstream of the supply orifice 57 and the chamber 33 through a one way check valve 62 and a damping orifice 64.

A pressure responsive member in the form of a piston 63 is mounted for sliding movement in the chamber 33. The piston 63 has a face 65 which is exposed to fluid at supply pressure downstream of the supply orifice 57 via the passage 61 and a face 67 which is exposed to fluid at supply pressure upstream of the supply orifice 57 through a conduit 69. A rod 71 is coupled to the face 67 of the piston 63 and projects through an end wall 73 of the body 29, and consequently, the area of the face 67 exposed to fluid under pressure is less than the area of the face 65 exposed to fluid under pressure.

A drive rod 75 is mounted for sliding movement in a bore 77 of the body 29. The opposite ends of the drive rod 75 project into the chambers 31 and 33, respectively. The slide valve 39, the piston 63, the drive rod 75 and the chambers 31 and 33 are all preferably coaxial. The drive rod 75 has a length which is less than the spacing between the faces 53 and 65 during normal operation of the hydraulic system 11.

During operation of the hydraulic system 11, the slide valve 39 serves, in effect, to measure or compare the flows through the supply conduit 35 and the return conduit 37. To accomplish this, the slide valve 39 is automatically moved axially in the chamber 31 to vary the areas of the return orifice 55 and the supply orifice 57 to as to maintain the pressure drops across each of these orifices substantially constant.

The slide valve 39 is axially positioned in the chamber 31 by forces acting on the faces 47 and 53. The pressure responsive face 47 is subjected to hydraulic fluid pressure upstream of the return orifice 55. This tends to move the slide valve 39 to the right as viewed in the drawing. Opposing this force is the force resulting from fluid pressure downstream of the return orifice 55 acting over an annular area of the pressure responsive face 53. In addition, the right end of the drive rod 75 is exposed to hydraulic fluid at the pressure which exists downstream of the supply orifice 57. This urges the drive rod 75 to the left into contact with a central region of the face 53. Accordingly, the axial position of the slide valve 39 is a function of return pressure on both sides of the return orifice 55 and supply pressure downstream of the supply orifice 57. Consequently, the axial position of the slide valve 39 is a function of the pressure drop across both of the orifices 55 and 57 during normal operation of the hydraulic system 11. However, as a practical matter, the diameter of the rod 75 is small, and so the primary control of the axial position of the slide valve 39 is the pressure drop across the return orifice 55.

During normal operation, the piston 63 is held to the righthand end of the chamber 33 by hydraulic fluid at supply pressure downstream of the supply orifice 57 acting on the face 65. Fluid at supply pressure upstream of the supply orifice 57 acts on the face 67, but in view of the differential areas of the faces 65 and 67, the piston 63 is held to the right as viewed in the drawing.

During normal operation of the hydraulic system 11, the leakage of hydraulic fluid from the actuator system 25 is less than a predetermined amount. If a leak greater than the predetermined amount occurs in the actuator system 25, the flow of hydraulic fluid through the supply orifice 57 will exceed the flow of hydraulic fluid through the return orifice 55 by greater than a predetermined amount. The area of the supply orifice 57 is controlled primarily by the pressure drop across the return orifice and, therefore, the area of the supply orifice is not increased. The increased flow through the supply orifice 57 produces a greater pressure drop and, consequently, the fluid pressure in the chamber 33 acting on the face 65 is reduced. This enables the fluid at supply pressure upstream of the supply orifice 57 to urge the piston 63 to the left from the normal operating position shown in the drawing. This leftward movement of the piston 63 is modulated by the damping orifice 64, which restricts the flow of fluid from the chamber 33 during this leftward movement to restrict the speed of the piston 63 and to thereby provide a time delay before the piston 63 engages the drive rod 75. After a predetermined amount of axial movement to the left, the piston 63 engages the righthand end of the drive rod 75 and pushes the drive rod 75 and the slide valve 39 to their leftmost positions in the chamber 31. In this shut-off position, the lands 41 and 43 of the slide valve 39 completely close and shut off the orifices 55 and 57, respectively, to hydraulically isolate the leaking actuator system 25 from the pump 15 and the reservoir 19. The piston 63 will hold the slide valve 39 in the shut off position until the circuit breaker 13 is reset.

It can be seen, therefore, that the slide valve 39 performs two important functions. First, the slide valve 39 measures or compares supply and return flow. Secondly, the slide valve 39 closes the orifices 55 and 57 if leakage from the actuator system 25 exceeds a predetermined magnitude.

The drive rod 75 also performs two functions. First, it applies a force to the slide valve 39 during normal operation as described above which helps position the slide valve to control the areas of the variable area orifices 55 and 57. Secondly, in a failure mode, it serves as a power transmission element to drivingly couple the piston 63 and the slide valve 39.

During normal operation of the hydraulic system 11, the piston 63 is spaced axially from the drive rod 75. This provides, in effect, some lost motion which allows the piston 63 to move somewhat to the left without driving the slide valve 39. With this arrangement, momentary surges through the supply orifice 57 resulting in an increased pressure drop across that orifice will not move the slide valve 39 to the shut-off position.

If desired, the movement of the rod 71 can be used to provide a signal indicating whether the hydraulic system is operating normally or in a shut-off mode.

To reset the system 11 after the circuit breaker 13 has moved to its shut off position, it is necessary to pressurize the chamber 33 to urge the piston 63 from its leftward shut off position to its normal operating position shown in the drawing. It is also necessary to provide a metered flow of fluid to pressure test the actuator system 25 and to respond to pressurization of the actuator system 25 which would indicate the absence of leakage. Both of these functions are accomplished by the hydraulic circuit breaker reset device 14 shown in the drawing and described below.

The reset device 14 is hydraulically connected with the circuit breaker 13 and with the actuator system 25, so that the reset device 14 can continuously pressure test the actuator system 25 and provide a reset signal to reset the circuit breaker 13. The reset device 14 includes a body which, in the embodiment illustrated in the drawing, is integral with the body of the circuit breaker 13. However, the body of the reset device 14 could alternatively be separate from but hydraulically connected to the circuit breaker 13. Additionally, various components of the reset device 14 described below could be arranged in an integral manner with the circuit breaker 13.

The reset device 14 includes a logic valve 81, a logic valve reset timing piston 83, an actuator system pressure test orifice 85, and a logic reset timing orifice 87.

The logic valve 81 is arranged to respond to a pressure increase in the actuator system 25 which indicates the absence of leakage, and to then provide a reset signal to the circuit breaker 13. The logic valve 81 includes a logic spool 89 slidably disposed within the housing and spring biased to the right as shown in the drawing by a spring 91. The logic valve 81 also includes an actuator system port 93, a circuit breaker reset port 95, a pump pressure port 97, and a drain or return port 99.

The spool 89 of the logic valve 81 includes lands which define a groove 101. In the normal operating position of the spool 89 shown in the drawing, the spool 89 isolates the reset port 95 from the remaining ports of the logic valve 81. When the spool 89 is in a rightward position described below, the groove 101 establishes fluid pressure communication between the pump pressure port 97 and the reset port 95.

The spool 89 also includes a groove 103 and a groove 105, both of which are communicated with the right end face of the spool 89 by an axial passage in the spool 89. In the normal operating position of the spool 89 shown in the drawing, the groove 103 establishes fluid pressure communication between the pump pressure port 97 and the right end face of the spool 89. When the spool 89 is moved to a rightward position described below, the groove 105 establishes communication between the return port 99 and the right end face of the spool 89. The left end face of the spool 89 is exposed to pressure of the actuator system port 93 downstream of the actuator system 25 and upstream of the circuit breaker return orifice 55 under all conditions.

The logic valve reset timing piston 83 is slidably disposed in the bore, preferably in a concentric arrangement with the spool 89. The timing piston 83 is shown in its normal operating condition in the drawing, and, as explained below, the timing piston 83 is movable to the left from the position shown in the drawing to move the spool 89 from a rightward position to a leftward position after the circuit breaker 13 has been reset.

The spool 89 and the piston 83 define a first chamber 107 on the left side of the spool 89, a second chamber 109 between the spool 89 and the piston 83, and a third chamber 111 on the right side of the piston 83. The timing orifice 87 restricts the flow of fluid into the chamber 111 to thereby restrict the rate of movement of the piston 83 to the left, and a one way check valve 113 permits flow of fluid out of the chamber 111 around the orifice 87 to permit rapid movement of the piston 83 to the right.

Referring now to the operation of the reset device 14, the spool 89 and piston are disposed in the positions shown in the drawing under normal operating conditions of the hydraulic circuit 11. Under these conditions, the groove 103 communicates pump pressure from the pump port 97 to the chamber 109. This pressure in the chamber 109 maintains the piston 83 into the right as shown in the drawing, since the chamber 111 is at a lower pressure equal to that downstream of the circuit breaker supply orifice 57. The pump pressure in the chamber 109 also maintains the spool 89 to the left, since the combined force of the spring 91 and the actuator return pressure upstream of the return orifice 55 acting on the left end of the spool 89 is less than the force of the pump pressure in the chamber 109 acting on the right end face of the spool 89.

As explained above in connection with the circuit breaker 13, a trip of the circuit breaker 13 will result in the circuit breaker piston 63, a drive rod 75, and spool 39 being in their leftmost positions. In these leftmost positions of the circuit breaker 13, the supply orifice 57 and the return orifice 55 are closed. Under these conditions, the pressure test orifice 85 communicates a small metered flow of fluid from the supply conduit 35 to the actuator system 25. If there is a leak in the actuator system 25 greater than a predetermined amount, pressure will not build in the actuator system 25. In this event, the reset device 14 will not operate to reset the circuit breaker 13. However, if the leakage in the actuator system 25 is less than a predetermined amount, the small flow through the pressure test orifice 85 will pressurize the actuator system 25 upstream of the closed return orifice 55. This pressurization upstream of the return orifice 55 will cause increased pressure in the chamber 107. Because the return orifice 55 is closed and the flow through the actuator system 25 is very small or negligable, the pressure in the chamber 107 will be nearly equal to the pump pressure in the chamber 109. The combined force of this increased pressure in the chamber 107 and the spring 91 will move the spool 89 to its rightmost position. In this rightmost position of the spool 89, the groove 101 will establish fluid pressure communication between the pump port 97 and the circuit breaker reset port 95. Fluid will then flow through the circuit breaker reset port 95 to the chamber 33 to move the piston 63 to the right and reset the piston 63. This will permit the pressure in the chamber 31 upstream of the return orifice 55 to move the spool 39 to the right. This will open the supply orifice 57 and the return orifice 55, so that the circuit breaker 13 will perform in the manner described above.

With the spool 89 in its rightward position, the groove 105 connects the chamber 109 to the return port 99. When this occurs, the timing orifice 87 provides a small flow rate of fluid to the chamber 111 to begin moving the logic valve reset timing piston 83 and the logic valve 81 to the left. Because the orifice 87 restricts this flow of fluid into the chamber 111, the logic spool 89 will not be returned to its leftward position until after the piston 63 has been returned to its rightward position. When the logic valve spool 89 is returned to its leftward position, the groove 103 again communicates pump pressure to the chamber 109 to hydraulically bias the spool 89 in its leftward position. The pump pressure in the chamber 109 also returns the piston 83 to the right, and the volume of fluid in the chamber 111 flows through the one-way check valve 113 to permit this rightward movement of the piston 83. The piston 83 and spool 89 are then returned to the positions shown in the drawing under normal operating conditions to await the next trip of the circuit breaker 13.

When the hydraulic system 11 is operating under normal operating conditions and is then shut down such as by terminating flow from the pump 15, the piston 63 will remain in the position shown in the drawing and will not have to be reset when the system 11 is started up. However, the spring 91 will move the logic spool 89 to the right. When the system 11 is then restarted, pump pressure will act on both sides of the piston 63 to retain the piston 63 in the position shown in the drawing. Fluid will then flow through the timing orifice 87 to displace the reset piston 83 to the left to reset the logic spool 89 in the manner described above. Additionally, if there is no leakage in the actuator system 25, fluid will flow through the supply orifice 57 and the return orifice 55, and the system 11 will operate under its normal operating conditions described above.

What is claimed is:

1. A hydraulic system comprising:

a hydraulic circuit breaker, a hydraulic circuit breaker reset device, a supply conduit for supplying hydraulic fluid under pressure to a hydraulic device supply port, a return conduit for returning hydraulic fluid from a hydraulic device return port, said hydraulic circuit breaker including movable actuator means interrupting the flow of fluid through at least one of said conduits in response to the fluid flow rate through said supply conduit exceeding the fluid flow rate through said return conduit by a predetermined differential, said reset device including pressure test conduit means establishing restricted fluid pressure communication between said supply conduit and at least one of said hydraulic device ports when said actuator means is interrupting said flow, and said reset device including reset conduit means supplying a reset fluid pressure signal to said actuator means in response to a fluid pressure increase in at least one of said hydraulic device ports.

2. A hydraulic system as set forth in claim 1, wherein said reset device includes:

a housing, a bore in said housing, a logic valve in said bore, said logic valve being movable between a first position and a second position in said bore, said logic valve including means closing said reset conduit means when said logic valve is in said first position and means opening said reset conduit means when said logic valve is in said second position.

3. A hydraulic system as set forth in claim 2, including:

a timing piston, means biasing said logic valve to said second position, and means moving said logic valve from said second position to said first position, said last mentioned means including said timing piston.

4. A hydraulic system as set forth in claim 3, including a first chamber in said bore defined by a first lateral area on said logic valve, a second chamber in said bore defined by a second lateral area on said logic valve and by said timing piston, conduit means establishing hydraulic pressure communication between said first chamber and at least one of said hydraulic device ports, and conduit means establishing pressure communication between said second chamber and said supply conduit when said logic valve is in said first position to hydraulically bias said logic valve in said first position.

5. A hydraulic system comprising:

a hydraulic circuit breaker, a hydraulic circuit breaker reset device, a supply conduit for supplying hydraulic fluid under pressure to a hydraulic device supply port, a return conduit for returning hydraulic fluid from a hydraulic device return port, said hydraulic circuit breaker including movable actuator means interrupting the flow of fluid through at least one of said conduits in response to the fluid flow rate through said supply conduit exceeding the fluid flow rate through said return conduit by a predetermined differential, said reset device including logic valve means supplying a reset fluid pressure signal to said actuator means in response to a fluid pressure increase in one of said hydraulic device ports, and said logic valve means including a lateral cross sectional area defining a chamber exposed to fluid pressure in said one hydraulic device port.

6. A hydraulic system as set forth in claim 5, wherein said one hydraulic device port is said hydraulic device return port.

7. A hydraulic system as set forth in claim 6, where said hydraulic circuit breaker includes a supply orifice and a return orifice, both of said orifices being closed by said movable actuator means in response to said predetermined differential, and said hydraulic device return port is upstream of said hydraulic circuit breaker return orifice.

8. A hydraulic system as set forth in claim 7, wherein said hydraulic device supply port is downstream of said hydraulic circuit breaker supply orifice, and said reset device includes pressure test orifice means establishing restricted fluid pressure communication between said supply conduit upstream of said hydraulic circuit breaker supply orifice and said hydraulic device supply port.

9. A hydraulic circuit breaker reset device comprising a housing having a bore, a supply port and a return port and a reset port in said housing, a logic valve movable in said bore between a first position and a second position, said logic valve having a first lateral cross sectional area defining a first chamber and a second lateral cross sectional area defining a second chamber, means carried by said logic valve establishing fluid pressure communication between said supply port and said second chamber when said logic valve is in said first position, whereby fluid pressure in said second chamber urges said logic valve toward said first position, means carried by said logic valve establishing fluid pressure communication between said return port and said second chamber when said logic valve is in said second position, means carried by said logic valve establishing fluid pressure communication between said supply port and said reset port when said logic valve is in said second position, and orifice means establishing restricted fluid pressure communication between said supply port and said first chamber, whereby fluid pressure in said first chamber urges said logic valve toward said second position.

10. A hydraulic circuit breaker reset device as set forth in claim 9, including timing piston means moving said logic valve from said second position to said first position in response to fluid pressure increase in said reset port.

11. A hydraulic circuit breaker reset device as set forth in claim 10, wherein said timing piston means includes a lateral cross sectional area defining said second chamber and another lateral cross sectional area defining a third chamber, and means establishing restricted fluid pressure communication between said reset port and said third chamber.

12. A hydraulic circuit breaker reset device as set forth in claim 11, including spring means biasing said logic valve from said first position toward said second position.

13. A hydraulic circuit breaker reset device comprising a logic valve and a timing piston, said logic valve having a supply port, a return port, and a reset port, said logic valve being movable relative to said ports between a first position and a second position, means carried by said logic valve hydraulically isolating said supply port and said reset port when said logic valve is in said first position, means carried by said logic valve establishing hydraulic pressure communication between said supply port and said reset port when said logic valve is in said second position, said timing piston having a first lateral cross sectional area, and said timing piston including means operable to move said logic valve from said second position to said first position in response to fluid pressure acting on said first area.

14. A hydraulic circuit breaker reset device as set forth in claim 13, wherein said timing piston includes a second lateral cross sectional area, said logic valve includes third and fourth lateral cross sectional areas, a first chamber defined by said first area, a second chamber defined by said second and third areas, reset orifice means establishing restricted hydraulic pressure communication between said reset port and said first chamber, whereby hydraulic pressure in said reset port will be restrictively communicated to said first chamber to cause said timing piston to move said logic valve from said second position to said first position, said logic valve including means establishing hydraulic pressure communication between said return port and said second chamber when said logic valve is in said second position, and said logic valve including means establishing hydraulic pressure communication between said supply port and said second chamber when said logic valve is in said first position.

15. A hydraulic circuit breaker reset device for use with a hydraulic circuit breaker, comprising:

a housing having a supply conduit and a return conduit and a reset conduit, a bore in said housing, a logic valve in said bore, said logic valve having a first lateral cross sectional area defining a first chamber and a second lateral cross sectional area defining a second chamber, said logic valve being movable in said bore between a first position and a second position, means hydraulically isolating said supply conduit from said reset conduit when said logic valve is in said first position, means hydraulically connecting said supply conduit and said reset conduit when said logic valve is in said second position, means biasing said logic valve to said second position, means moving said logic valve against said biasing means from said second position to said first position and retaining said logic valve in said first position in response to a predetermined pressure increase in said reset conduit, and means establishing restricted fluid pressure communication between said supply conduit and said first chamber, whereby fluid pressure in said first chamber urges said logic valve toward said second position.

* * * * *